United States Patent [19]

Chow

[11] 4,285,561

[45] Aug. 25, 1981

[54] TRANSMISSION CABLE MASS TERMINATION

[75] Inventor: Weichien Chow, Park Forest, Ill.

[73] Assignee: Bunker Ramo Corporation, Oak Brook, Ill.

[21] Appl. No.: 55,921

[22] Filed: Jul. 6, 1979

Related U.S. Application Data

[63] Continuation of Se No. 871,908, Jan. 24, 1978, abandoned.

[51] Int. Cl.[3] ..... H01R 9/07; H01R 11/20

[52] U.S. Cl. ..... 339/14 R; 339/97 P

[58] Field of Search ..... 339/14 R, 14 P, 17 F, 339/96, 97 R, 97 P, 98, 99 R, 97. C; 174/75 R

[56] References Cited

U.S. PATENT DOCUMENTS

| | | | |
|---|---|---|---|
| 3,149,893 | 9/1964 | Dupre | 339/14 R |
| 3,737,833 | 6/1973 | Jerominek | 339/17 F |
| 3,824,529 | 7/1974 | Dorrell | 339/14 R |
| 3,924,923 | 12/1975 | Shoemaker | 339/96 X |
| 3,934,075 | 1/1976 | Dilliplane | 174/75 R |
| 4,005,921 | 2/1977 | Hadden et al. | 339/14 R |
| 4,027,941 | 6/1977 | Narozny | 339/14 R |
| 4,073,560 | 2/1978 | Anhalt et al. | 339/99 R |
| 4,074,929 | 2/1978 | Krider | 339/97 R |

FOREIGN PATENT DOCUMENTS

| | | | |
|---|---|---|---|
| 948391 | 2/1964 | United Kingdom . | |
| 1114461 | 5/1968 | United Kingdom | 339/17 F |
| 1239227 | 7/1971 | United Kingdom . | |

OTHER PUBLICATIONS

Western Electric Technical Digest No. 35, Jul. 1974, "Terminating Flat Cable on Two-Row Connector".

*Primary Examiner*—Neil Abrams
*Attorney, Agent, or Firm*—F. M. Arbuckle; J. R. Hoffman

[57] ABSTRACT

A novel mass termination assembly for flat cable is disclosed for use with cable having very closely spaced conductors. The assembly includes connector means to terminate selected conductors, isolation means to inactivate certain other selected conductors at the locus of the termination and bridging means to electrically couple the inactivated conductors to the connector means. The assembly allows the use of insulation-piercing termination devices without the danger of shorting between the closely spaced adjacent conductors.

11 Claims, 6 Drawing Figures

10
12
14
16
18
19
20
21
23
23'
24
26
30
32
34
36
38
40
42
48
50
2
3

TRANSMISSION CABLE MASS TERMINATION

This is a continuation application of application Ser. No. 871,908, filed Jan. 24, 1978, now abandoned.

BACKGROUND OF THE INVENTION

The present invention is directed generally to electrical connection assemblies and, more particularly, to an assembly for terminating a flat electrical cable having a plurality of electrical transmission or signal conductors and ground conductors arranged in a closely-spaced array within a strip of insulative material.

In recent years flexible, flat multiconductor cable has been used with increasing frequency in the communications, data processing and transportation industries. Flat cable is particularly well suited for electrically connecting high density banks of circuit elements used in modern computers. To effect these connections rapidly and economically, a variety of different conductors, connector assemblies or "mass termination" systems have been developed. Conventional solder and crimp type terminations and, more recently, insulation-piercing terminations have been satisfactorily employed in these assemblies to terminate the conductors of the flat cable with the connector. One flat cable connector illustrative of such prior art devices is that disclosed in U.S. patent application Ser. No. 855,636, filed Nov. 29, 1977, now U.S. Pat. No. 4,160,574.

Although these prior art termination assemblies have met with some commercial success, they all suffer from the disadvantage that they are not suitable for use with cable having very closely spaced conductors. For example, insulation-piercing terminations used in the prior art are useful only with cable having conductors spaced at intervals of about 0.050 inch or more. When the conductors are spaced at intervals of about 0.030 inch or less, conventional insulation-piercing termination devices are susceptible to shorting which is, of course, unacceptable.

Accordingly, all known connection assemblies used with flat cable having very closely spaced conductors employ solder-type terminations and arrangements of components which effect a greater spacing between the conductors to facilitate the soldering operation. These assemblies are not only relatively expensive, but the soldering operation is labor intensive, thereby increasing their installation cost.

SUMMARY OF THE INVENTION

The present invention, therefore, is directed to a mass termination system for flat cable having very closely spaced conductors which overcomes the problems and disadvantages associated with prior art devices. The termination system or assembly of the present invention may be used to terminate a cable with conductors spaced at about 0.015 inch intervals and may in some applications employ conventional connectors including those presently adapted for the 0.050 inch conductor spacing found in most standard flat cable. Moreover, the assembly may employ insulation-piercing terminations without the danger of shorting between adjacent transmission conductors.

The invention finds particular application for terminating flat cable having electrical transmission or signal conductors with ground conductors disposed therebetween and generally comprises connector means, isolation means and bridging means. The connector means includes terminal means for electrically engaging the signal conductors and active contact means in electrical communication with the terminal means for electrically interconnecting the signal conductors to an associated electrical component. The isolation means breaks the electrically conductive path between the connector means and the live ground conductors and may comprise apertures in the cable which sever the ground conductors, resulting in "dead" ground conductors along the length of cable where the termination is effected. The bridging means comprises a conductive member which electrically joins the live portion of the ground conductors to a ground terminal within the connector.

BRIEF DESCRIPTION OF THE DRAWINGS

The novel features which are believed to be characteristic of the invention are set forth in the appended claims. The invention, itself, however, together with further objects and attendant advantages thereof, will be best understood by reference to the following description taken in connection with the accompanying drawings in which:

DETAILED DESCRIPTION OF THE INVENTION

Figures 1, 2, 3, 4:
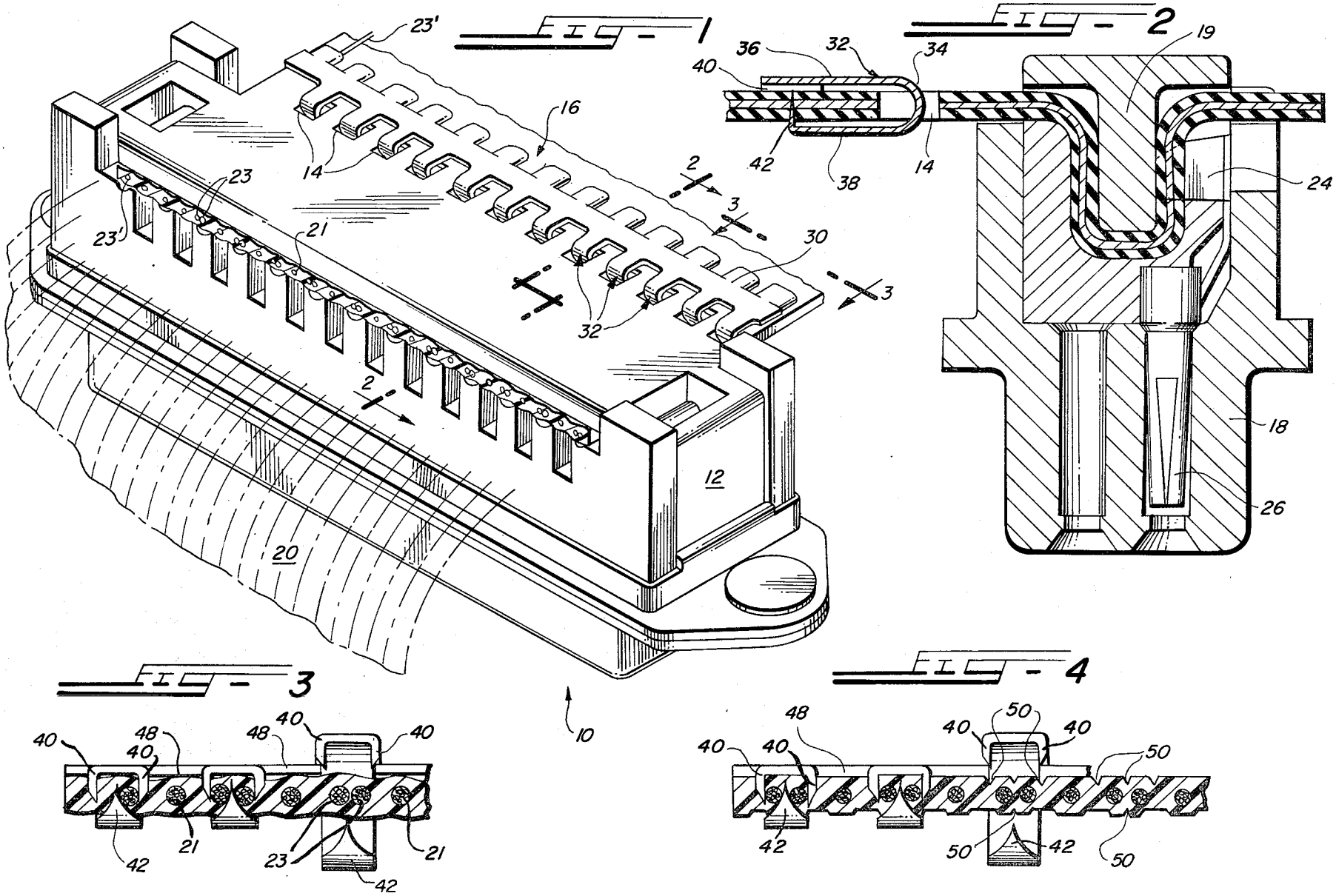
FIG. 1 is a perspective view illustrating the termination assembly of the present invention and showing the arrangement of a preferred connector means, isolation means and bridging means with a flat cable.
FIG. 2 is an enlarged cross-sectional view taken along line 2—2 of FIG. 1 and showing in detail an insulation-piercing terminal means and an active contact means.
FIG. 3 is an enlarged cross-sectional view taken along line 3—3 in FIG. 1 showing one preferred bridging means and with one of the terminal members of the bridging means in the open position.
FIG. 4 is a view similar to that of FIG. 3 illustrating a preferred surface configuration for the flat cable used with the present invention.

Referring now to FIG. 1, the mass termination assembly of the present invention, designated generally as 10, is illustrated in one of its preferred embodiments terminating a flat cable 20. The assembly 10 includes a connector means 12, isolation means comprising a series of apertures 14 in cable 20, and bridging means 16.

The illustrated cable 20 is particularly well suited for use with the termination assembly of the present invention and comprises a plurality of signal or power carrying conductors 21 and a plurality of ground conductors 23, one or more of the ground conductors being interposed between adjacent signal conductors. The conductors 21 and 23 are spaced by as little as 0.015 inch, and, accordingly, it is difficult to terminate the signal conductors 21 by use of conventional insulation-piercing terminals without shorting to adjacent ground conductors 23.

The connector means 12 may be any one of a variety of different connectors well known to those skilled in the art for use in terminating flat cable. The connector means illustrated in the drawings is similar to that described in the aforementioned U.S. application Ser. No.

855,636, and the structure and function of the connector means may be readily understood from the disclosure of this application which is incorporated herein by reference. Generally, the connector means 12 includes a two-piece housing having a base 18 and a cover portion 19 made from dielectric material and which support and enclose a plurality of contacts 22. The contacts 22 comprise a terminal portion 24 for electrically engaging an individual signal conductor of the cable 20 and an active contact portion 26 which mates with an electrical component to be interconnected with the cable. In the illustrated embodiment, the contacts 22 comprise an insulation-piercing terminal portion and a multi-tine socket, active contact portion. Of course, the use of insulation-piercing contacts greatly facilitates the termination operation, and, as described in greater detail below, the present invention enables the use of such termination means even with the cable 20 having very closely spaced conductors 21 and 23.

The isolation means comprises, in the preferred embodiment, a series of apertures 14 which sever the ground conductors 23 so that along the portion of the cable 20 cooperating with the connector 12 the conductors 23 are "dead" and do not act as a ground path. Accordingly, along this portion of the conductor the spacing between active conductors is actually the interval between adjacent signal conductors 21. In cable 20, the conductors 21 are at 0.050 inch intervals and, therefore, conventional flat cable connectors can be used to effect the termination.

Figure 5:
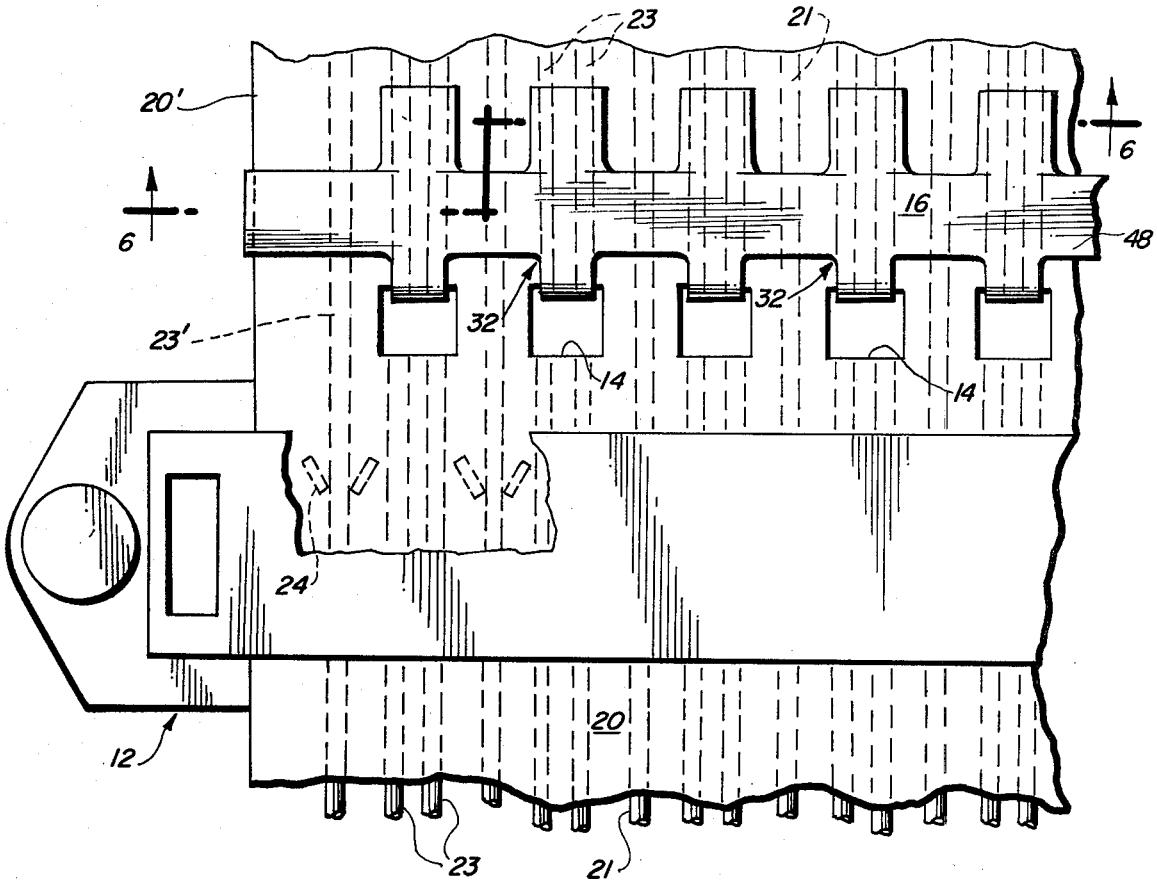
FIG. 5 is an enlarged fragmentary plan view illustrating further details of the termination assembly shown in FIG. 1.
Figure 6:
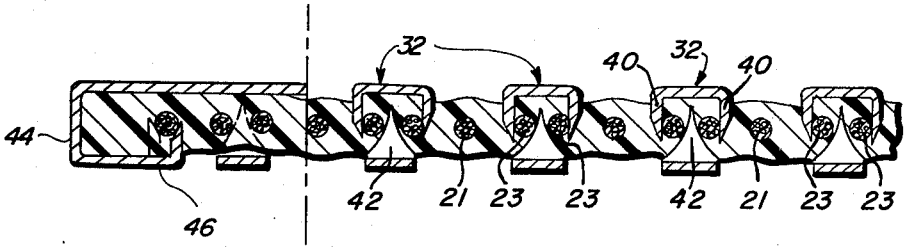
FIG. 6 is a cross-sectional view taken along the line 6—6 of FIG. 5.

In order to provide a ground path to and from the connector, the bridging means 16 is utilized to electrically couple each of the ground conductors 23 to a single ground conductor 23' which may be conveniently located at one edge 20' of the cable 20. The bridging means illustrated in the drawings comprises an elongated clip 30 which may be easily fabricated from sheet metal by conventional stamping and forming operations. The clip 30 includes a plurality of U-shaped termination members 32, each having a bight portion 34 passing through an aperture 14 and leg portions 36 and 38 which overlie the opposed surfaces of the cable. The free ends of each leg portion are formed into flange-like, insulation-piercing terminal means 40 and 42, and at least one of the terminal means is positioned and configured to make electrical contact with the ground conductors 23. As most clearly seen in FIGS. 5 and 6, the clip 30 includes a terminal member 44 which extends over and is folded under the lateral edge 20' of the cable. The member 44 has a termination flange 46 at its distal end which engages conductor 23', the live ground path into the connector 12. The members 32 are joined to each other and to terminal member 44 by a strip or web 48, forming a unitary ground clip and, thus, a continuous ground path from each ground conductor 23, through terminal 44 and conductor 23', into the connector 12. Of course, in those instances where the flat cable continues to a further connector or other electrical components, another ground clip may be installed in a similar manner on the "down stream" side of connector 12.

FIG. 4 illustrates a preferred external configuration for the cable 20, having spaced longitudinal grooves 50 positioned to assist the proper orientation and penetration of the terminal means 40 and 42 into the cable and conductors 23. The grooves are particularly useful when the insulation used in the flat cable is very hard and might have a tendency to deform or misdirect the piercing tips of the terminal means.

Installation of the termination assembly of the present invention is simple and may be completed in a very short time. The connector means 12 is assembled to the cable 20 in an entirely conventional and well known manner, and the apertures 14 may be formed with a hand punch or a tool specially designed for this purpose. The clip 30 is then assembled to the cable by inserting the legs 38 through the apertures 14 and crimping each terminal member 32 to pierce the insulation of the cable and electrically engage the ground conductors 23. The terminal member 44 is then folded over edge 20' and crimped to the cable to electrically engage conductor 23'. For predetermined installations, the cable may be prepunched and the clip 30 assembled to the cable 20 in the factory to eliminate these operations in the field.

Of course, it should be understood that various changes and modifications to the preferred embodiment described herein will be apparent to those skilled in the art. Such changes and modifications can be made without departing from the spirit and scope of the present invention and without diminishing its attendant advantages. For example, other structures and configurations may be used for the clip 30 and terminal members 32 and 44. In addition, other isolation means may be employed in place of apertures 14. Finally, the isolation means and bridging means need not be located adjacent the connector means as shown, but may be remote from the connector where such an arrangement will ease and facilitate installation or service and maintenance. It is, therefore, intended that all such changes and modifications be covered by the following claims.

I claim:

1. An assembly for terminating an electrical cable having a plurality of first conductors for transmitting electrical signals or power to an associated electrical component and ground conductors, all of said conductors carried in a flat strip of insulative material, said assembly comprising:

a connector including terminal means for electrically engaging one or more of said first conductors, and active contact means in electrical communication with said terminal means for electrical connection to said associated component;

means associated with said cable outside said connector for isolating said connector from the ground conductors of said cable; and means for bridging said isolation means to electrically join at least one of said ground conductors to a ground terminal within said connector.

2. The assembly of claim 1 wherein said bridging means comprises a clip means having terminal means for electrically engaging at least one of said ground conductors and conductive means for electrically joining said clip to said ground terminal.

3. The assembly of claim 1 wherein said isolation means comprises at least one aperture in said cable, said aperture being formed in said cable to sever one or more ground conductors without impeding the transmission of said electrical signals or power through said cable.

4. The assembly of claim 1 wherein said bridging means comprises a clip means having insulation-piercing terminal means for electrically engaging said ground conductors and conductive means for electrically joining said clip to said ground terminal, and wherein said insulative material has a surface configuration to guide the clip terminal means into engagement with said ground conductors.

5. The assembly of claim 2 wherein said clip means includes at least one sheet metal and generally U-shaped member, the free ends of said member having means for piercing said insulation from opposite sides of said cable, at least one of said insulation-piercing means positioned and configured to electrically engage said ground conductor thereby providing said clip terminal means.

6. The assembly of claim 5 wherein said clip means includes a plurality of said U-shaped members, and a web joining said members to thereby form a unitary ground clip.

7. The assembly of claim 1 wherein said connector terminal means comprises a plurality of insulation-piercing members, each electrically engaging a single one of said first conductors.

8. An assembly for terminating an electrical cable having a plurality of first conductors for transmitting electrical signals or power to an associated electrical component and at least one ground conductor disposed between adjacent first conductors, all of said conductors arranged in a generally planar array, said assembly comprising:

a connector including terminal means for electrically engaging at least one of said first conductors, and active contact means in electrical communication with said terminal means for electrical connection to said associated component;

means associated with said cable outside said connector for isolating said connector from the ground conductors of said cable; and means for bridging said isolation means to electrically join said ground conductor to a ground terminal associated with said connector.

9. An assembly for terminating an electrical cable having a plurality of first conductors for transmitting electrical signals or power to an associated electrical component and ground conductors, all of said conductors carried in a flat strip of insulative material, said assembly comprising:

a connector including terminal means for electrically engaging one or more of said first conductors, and active contact means in electrical communication with said terminal means for electrical connection to said associated component;

means for isolating said connector from the ground conductors of said cable, said isolation means including at least one aperture in said cable positioned to sever one of more ground conductors without impeding the transmission of said electrical signals or power through said cable; and means for bridging said isolation means to electrically join at least one of said ground conductors to a ground terminal within said conductors.

10. An assembly for terminating a flat electrical cable having first conductors for transmitting electrical signals or power to an associated electrical component and ground conductors, all of said conductors being carried in a flat strip of insulative material, said assembly comprising:

a connector including terminal means for electrically engaging one or more of said first conductors;

means associated with said cable and removed from said terminal means longitudinally of said cable for isolating one or more of said ground conductors from said terminal means, said isolation means comprising at least one aperture in said cable, said aperture being formed in said cable to sever one or more ground conductors without impeding the transmission of said electrical signals or power through said cable; and means for bridging said isolation means to electrically join at least one of said ground conductors to a ground terminal on said connector.

11. An assembly for terminating a flat electrical cable having first conductors for transmitting electrical signals or power to an associated electrical component and ground conductors, all of said conductors being carried in a flat strip of insulative material, said assembly comprising:

a connector including terminal means for electrically engaging one or more of said first conductors;

means associated with said cable for isolating one or more of said ground conductors from said terminal means without separating the ground conductors from the plane of said flat cable, said isolation means comprising at least one aperture in said cable, said aperture being formed in said cable to sever one or more ground conductors without impeding the transmission of said electrical signals or power through said cable; and means for bridging said isolation means to electrically join at least one of said ground conductors to a ground terminal on said connector.

* * * * *